US005579752A

United States Patent [19]

Nelson et al.

[11] Patent Number: 5,579,752

[45] Date of Patent: Dec. 3, 1996

[54] ADJUSTABLE BOW SIGHT

[75] Inventors: Richard F. Nelson, Mt. Pleasant; Paul J. Kenny, Shepherd; Christopher D. Smith, Clare, all of Mich.

[73] Assignee: EBSA Corporation, Shepherd, Mich.

[21] Appl. No.: 400,370

[22] Filed: Mar. 8, 1995

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 2,163,503 | 6/1939 | Tate . | |
| 2,351,103 | 6/1944 | Brown . | |
| 2,542,501 | 2/1951 | Fredrickson . | |
| 2,545,454 | 3/1951 | Fredrickson . | |
| 2,767,472 | 10/1956 | Kocur . | |
| 2,959,860 | 11/1960 | Kowalcyk . | |
| 3,058,221 | 10/1962 | McNeel . | |
| 3,063,151 | 11/1962 | Hanson . | |
| 3,266,149 | 8/1966 | Powell . | |
| 3,410,644 | 11/1968 | McLendon . | |
| 3,574,944 | 4/1971 | Reynolds . | |
| 4,215,484 | 8/1980 | Lauffenburger | 33/265 |
| 4,535,747 | 8/1985 | Kudlacek | 124/87 |
| 4,584,777 | 4/1986 | Saunders | 33/265 |
| 4,662,347 | 5/1987 | Carlton | 124/87 |
| 4,910,874 | 3/1990 | Busch | 33/265 |
| 4,915,088 | 4/1990 | Powers | 124/87 |
| 4,918,823 | 4/1990 | Santiago | 33/241 |
| 4,977,678 | 12/1990 | Sears | 33/265 |
| 4,993,158 | 2/1991 | Santiago | 33/253 |
| 5,208,407 | 5/1993 | Stover | 42/102 |
| 5,305,728 | 4/1994 | Young et al. | 124/87 |
| 5,367,780 | 11/1994 | Savage | 33/265 |

*Primary Examiner*—John A. Ricci
*Attorney, Agent, or Firm*—Howard & Howard

[57] ABSTRACT

An adjustable bow sight assembly (10) includes a mounting plate (16) extending between first and second ends (18, 20). End caps (24, 26) include longitudinal channels (28) for receiving the ends (18, 20) in sliding engagement therein. Each of the end caps (24, 26) also include a transverse aperture (44) therethrough to receive a sight bar (40, 42) slidably therein. The assembly (10) is adjustable by sliding the end caps in the vertical direction and the sight bars (40, 42) in the horizontal direction, and thereafter clamping same in a selected position by fasteners.

12 Claims, 3 Drawing Sheets

ADJUSTABLE BOW SIGHT

TECHNICAL FIELD

The invention relates to a target sight apparatus which is adapted to be connected to an archery bow or other shooting device, to allow adjustment of the sight along two directions.

BACKGROUND OF THE INVENTION

Target sight assemblies are commonly known in the art to aid the user of an archery bow for aiming purposes. Such sights include adjustment of the sight along two directions, i.e., horizontally and vertically. This compensates for variation in the way the archery bow is utilized. For example, each user will pull back and release the arrow differently which may cause the arrow to naturally be offset from center, and such sight assemblies can adjust for this offset.

Various target sights are known which utilize both forward and rearward adjustable sight pins which are to be aligned with the desired target. Exemplary of such sights are U.S. Pat. No. 4,981,823 and U.S. Pat. No. 4,993,158, both to Santiago. The patents disclose a front and rear adjustable sight system typically used on a hand gun or rifle which includes aligning a front sight bar between the rear sight assembly including spaced apart sight pins.

U.S. Pat. No. 5,305,728 in name of Young et al discloses an adjustable bow sight including a generally rectangular mounting plate having a first end spaced forwardly of the bow riser and a second end spaced rearwardly of the bow riser. The bow sight includes a front sight mounting bracket slidably mounted to the first end of the mounting plate. The front sight mounting bracket includes a pair of slots for adjustment along the mounting plate in the vertical or elevational direction. A front sight plate includes a front sight pin and is slidably mounted on the front sight mounting bracket. The front sight plate further includes a pair of slots for slidably adjusting the front sight pin in the lateral or windage direction. Similarly, a rear sight mounting bracket is slidably secured to the second end of the mounting plate and includes a pair of slots for adjusting the mounting bracket in the vertical or elevational direction. A rear sight plate is received on the mounting bracket and includes a pair of spaced apart upwardly extending rear sight pins for sight alignment with the front sight pin. The rear sight plate also has a pair of slots for adjusting the rear sight pins in the lateral or windage direction.

SUMMARY OF THE INVENTION

A bow sight assembly adapted to be secured to an archery bow includes a mounting plate extending between a first end and a second end. First and second end caps are slidably engaged over the first end and second end, respectively. The first and second end caps each include a channel formed therein for receiving the first and second ends allowing sliding in a first direction of the first and second end caps with respect to the mounting plate. Also included are first and second sight bars slidably connected to the first and second end caps, respectively, to allow sliding in a second direction, different from the first direction, of the first and second sight bars with respect to the first and second end caps.

FIGURES IN THE DRAWINGS

Advantages of the present invention will be readily appreciated as the same becomes better understood by reference to the following detailed description when considered in connection with the accompanying drawings wherein.

DESCRIPTION OF THE PREFERRED EMBODIMENT

Figure 1:
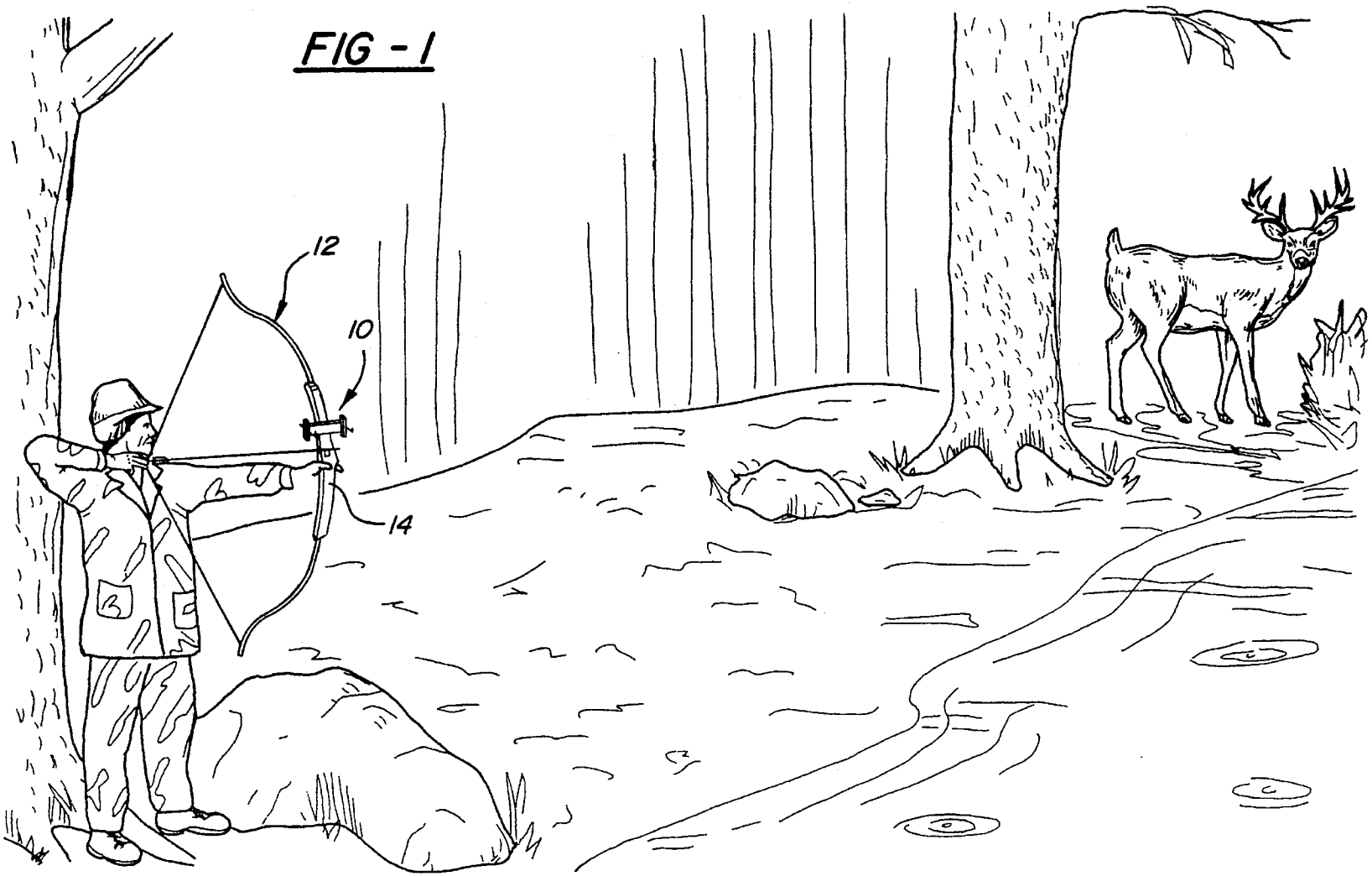
FIG. 1 illustrates use of the subject invention.
Figure 2:
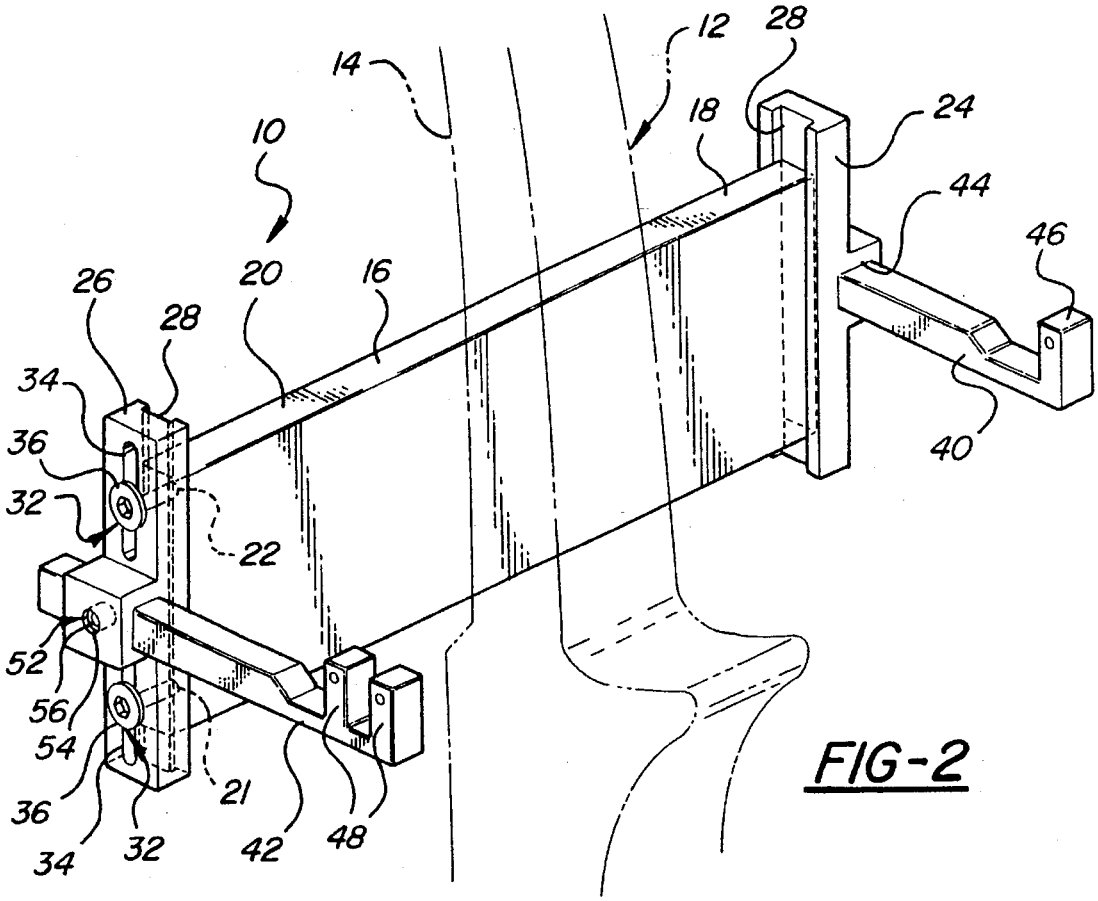
FIG. 2 is a perspective view of the subject invention.
Figure 3:
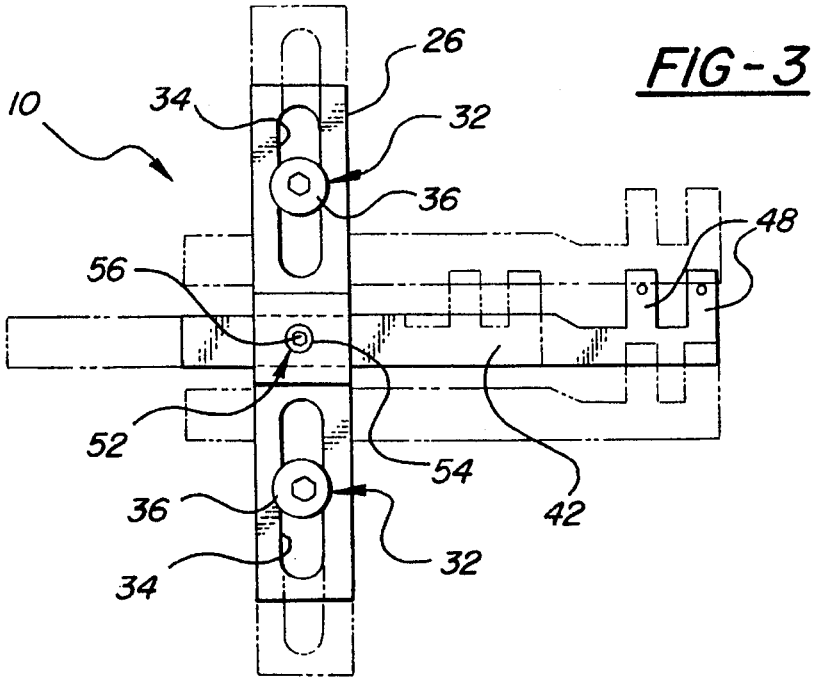
FIG. 3 is a side view of the subject invention illustrating adjustments.
Figure 4:
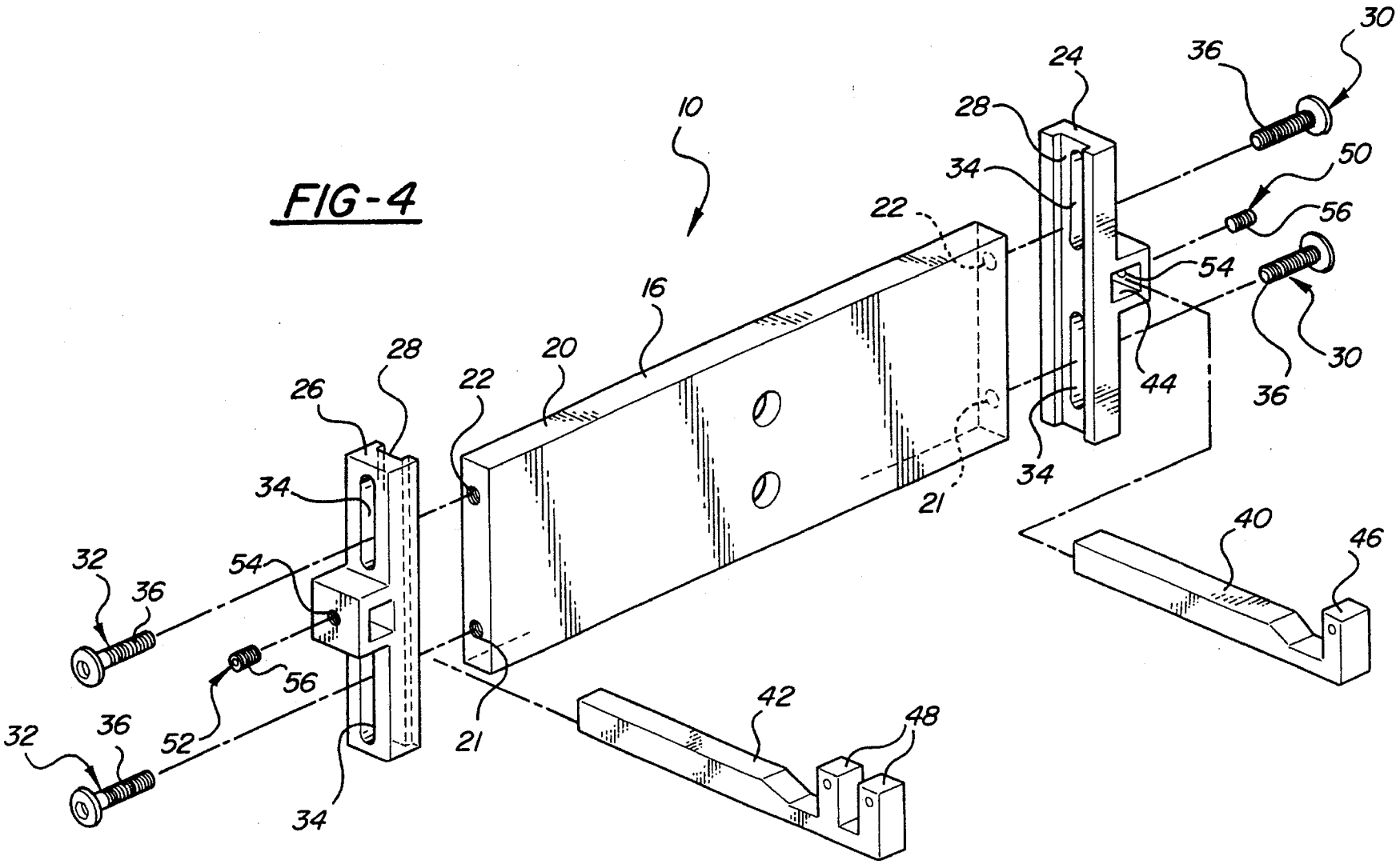
FIG. 4 is an exploded perspective view of the subject invention.

A sight assembly 10 is illustrated in the Figures. The sight assembly 10 is adapted to be secured to an archery bow 12 in its preferred embodiment as illustrated. The sight assembly 10 is fixedly connected by known means to the bow riser 14 of a typical compound or recurve type bow.

The assembly 10 includes a mounting plate 16 extending between a first end 18 and a second end 20. The mounting plate 16 generally comprises an elongated rectangular plate which extends longitudinally between the first and second ends 18, 20. The center portion of the mounting plate 16 is connected to the bow riser 14, or other shooting device, in any known manner, such as clamps, fasteners, brackets, etc. It is desirable to place the mounting plate 16 against the bow riser 14 with the first and second ends 18, 20 separated by the bow riser 14. The mounting plate 16 has a height and width greater than its thickness. The first and second ends 18, 20 both include a pair of threaded apertures 21, 22 extending longitudinally into the ends 18, 20 and spaced apart from one another at each end 18, 20.

The assembly 10 also includes first and second end caps 24, 26 slidably engaged over the first end 18 and second end 20, respectively. The first and second end caps 24, 26 each include a longitudinal channel 28 formed therein for receiving the first and second ends 18, 20 of the mounting plate 16 allowing sliding in a first direction of the first and second end caps 24, 26 with respect to the mounting plate 16. Each of the end caps 24, 26 are rectangular in shape having a longitudinal length extending a greater length than the width of the mounting plate 16. The channels 28 extend longitudinally along the length of the end caps 24, 26 and are recessed within the end caps 24, 26 to a depth of approximately half the width of the end caps 24, 26. The channel 28 is generally a U-shaped channel for receiving and allowing flat abutment of the first and second ends 18, 20 of the mounting plate 16 securely thereagainst.

The assembly 10 includes first and second securing means 30, 32 operatively connected between the mounting plate 16 and the first and second end caps 24, 26, respectively, for securing the first and second end caps 24, 26 in one of a plurality of positions along the first direction. Each of the securing means 30, 32 include at least one end opening 34 extending therethrough opposing the channel 28. Also included is a cap fastener 36 extending through the end opening 34 and threadably engaged in the threaded aperture 22, 21 of the mounting plate 16. The cap fastener 36 allows the mounting plate 16 to be clamped against the end caps 24, 26 in one of the plurality of positions along the first direction, and loosened to allow sliding movement of the end caps 24, 26 relative to the mounting plate 16. The cap fastener 36 may be commonly available hex-threaded fasteners which may be easily rotated by the user to either loosen or clamp the mounting plate 16 against the end caps 24, 26.

In the preferred embodiment, there are two end openings 34 longitudinally spaced, end-to-end, from one another in each of the end caps 24, 26. Accordingly, each of the end caps 24, 26 include a pair of cap fasteners 36, one utilized in each of the end openings 34.

The assembly 10 also includes first and second sight bars 40, 42 slidably connected to the first and second end caps 24, 26, respectively, to allow sliding in a second direction, different from the first direction, of the first and second sight bars 40, 42 with respect to the first and second end caps 24, 26. The end caps 24, 26 each include a transverse aperture 44 therethrough in the portion without the channel 28 for receiving the sight bars 40, 42 slidably therethrough. These sight bars 40, 42 generally comprise an elongated rectangular bar or shaft which extends through the aperture 44 for adjustment in the second direction. The sight bars 40, 42 include sight pins 46, 48 extending therefrom, respectively, to allow the user to aim at a target. Such sight pins 46, 48 are commonly known in the art. It is to be understood that such sight pins 46, 48 may comprise any type of sighting element, including a tritanium sight for increased low light visibility, as is commonly known in the art.

The assembly 10 also includes fastening means 50,52 operatively connected between the first and second end caps 24, 26 and the first and second sight bars 40, 42, respectively, for securing the first and second sight bars 40, 42 in one of a plurality of positions along the second direction. More specifically, each of the fastening means 50, 52 includes an end aperture 54 extending through the first and second end caps 24, 26 parallel with the end openings 34 and transverse to and intersecting the transverse apertures 44. The fastening means 50, 52 also each include a bar fastener 56 extending through the end aperture 54 to engage and clamp the sight bars 40, 42 against the end caps 24, 26 in one of the plurality of positions along the second direction. The bar fastener 56 may be of a similar type utilized in the cap fasteners 36; however, the bar fastener 56 merely abuts against the sight bars 40, 42 to clamp the sight bars 40, 42 against the aperture 44 and end caps 24, 26 to prevent sliding relative thereto. The bar fasteners 56 are loosened to allow relative sliding to a desired position in the second direction.

In operation, once the assembly 10 is connected to an archery bow or other target shooting device, the sight bars 40, 42 are visually aligned with one another, by sliding the end caps 24, 26 up and down in the vertical direction and by sliding the sight bars 40, 42 back and forth in the horizontal direction on a target and the fasteners 36, 56 tightened. A user may then shoot an arrow from the archery bow 12 and monitor whether the arrow hit the target or was offset therefrom. If the target was hit, the assembly 10 is properly adjusted. If the arrow did not hit the target, the assembly 10 must be adjusted to compensate for such offset. For example, if the arrow went to the right, the user would adjust the sight bars 40, 42 by sliding them in the second or horizontal direction, i.e., right. If the arrow went high, the end caps 24, 26 may be slid and moved in the first or vertical direction, i.e., upwardly. During adjustment, the fastener 36, 56 may be loosened to allow sliding of the associated members, and then tightly fastened thereto to prevent further sliding movement. Such adjustments are made until the user hits the target with an arrow.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A bow sight assembly (10) adapted to be secured to an archery bow (12), said assembly comprising:

a mounting plate (16) extending between a first end (18) and a second end (20);

first and second end caps (24, 26) slidably engaged over said first end (18) and said second end (20), respectively, said first and second end caps (24, 26) each including a channel (28) formed therein for receiving said first and second ends (18, 20) allowing sliding of said first and second end caps (24, 26) in a first direction with respect to said mounting plate (16); and first and second sight bars (40, 42) slidably connected to said first and second end caps (24, 26), respectively, to allow sliding of said first and second sight bars (40, 42) in a second direction different from said first direction with respect to said first and second end caps (24, 26).

2. An assembly as set forth in claim 1 further including first and second securing means (30, 32) operatively connected between said mounting plate (16) and said first and second end caps (24, 26), respectively, for allowing sliding movement and securing of said first and second end caps (24, 26) in one of a plurality of positions along said first direction.

3. An assembly as set forth in claim 2 further characterized by including first and second fastening means (50, 52) operatively connected between said first and second end caps (24, 26) and said first and second sight bars (40, 42), respectively, for allowing sliding movement and securing of said first and second sight bars (40, 42) in one of a plurality of positions along said second direction.

4. An assembly as set forth in claim 3 further characterized by each of said first and second sight bars (40, 42) including a sight pin extending therefrom for visual alignment on a target during use of said assembly.

5. An assembly as set forth in claim 3 further characterized by said first and second end caps (24, 26) including first and second transverse apertures (44) therethrough for receiving said first and second sight bars (40, 42) slidably therethrough.

6. An assembly as set forth in claim 5 further characterized by each of said first and second securing means (30, 32) including an end opening (34) extending through said first and second end caps (24, 26) aligned with said mounting plate (16), and including cap fasteners (36) extending through said end openings (34) and threadedly engaged in said ends (18, 20) of said mounting plate (16) to clamp said mounting plate (16) against said end caps (24, 26) in one of said plurality of positions along said first direction.

7. An assembly as set forth in claim 6 further characterized by each of said first and second fastening means (50, 52) including an end aperture (54) extending through said first and second end caps parallel with said end openings (34) and transverse to and intersecting said transverse apertures (44), and bar fasteners (56) extending through said end aperture (54) to engage and clamp said sight bars (40, 42) against said end caps (24, 26) in one of said plurality of positions along said second direction.

8. An assembly as set forth in claim 7 further characterized by each of said securing means (30, 32) including two spaced end openings (34) having longitudinally extending openings and spaced longitudinally from one another, each of said end openings (34) receiving a cap fastener (36).

9. An assembly as set forth in claim 8 further characterized by said mounting plate (16) comprising an elongated rectangular member extending longitudinally between said first and second ends.

10. An assembly as set forth in claim 9 further characterized by said end caps (24, 26) comprising rectangular members with height and width greater than said first and second ends.

11. A sight assembly (10) adapted to be secured to a shooting device (12), said assembly comprising:

a mounting plate (16) extending between a first end (18) and a second end (20);

first and second end caps (24, 26) slidably engaged at said first end (18) and said second end (20), respectively, allowing sliding of said first and second end caps (24, 26) in a first direction with respect to said mounting plate (16); and first and second sight bars (40, 42) slidably connected through said first and second end caps (24, 26), respectively, to allow sliding of said first and second sight bars (40, 42) in a second direction different from said first direction with respect to said first and second end caps (24, 26).

12. A sight assembly (10) adapted to be secured to a shooting device (12), said assembly comprising:

a mounting plate (16) extending between a first end (18) and a second end (20);

first and second end caps (24, 26), at least one of which is slidably engaged over said first end (18) and said second end (20), respectively, said first and second end caps (24, 26) each including a channel (28) formed therein for receiving said first and second ends (18, 20) allowing sliding of at least one of said first and second end caps (24, 26) in a first direction with respect to said mounting plate (16); and first and second sight bars (40, 42) at least one of which is slidably connected to said first and second end caps (24, 26), respectively, to allow sliding of one of said first and second sight bars (40, 42) in a second direction different from said first direction with respect to one of said first and second caps (24, 26), respectively.

* * * * *